United States Patent [19]

Howes et al.

[11] Patent Number: 4,915,280

[45] Date of Patent: Apr. 10, 1990

[54] FORMS FEED TRACTOR

[75] Inventors: James K. Howes; Jeffrey H. Paterra, both of Charlotte, N.C.

[73] Assignee: International Business Machines Corporation, Armonk, N.Y.

[21] Appl. No.: 209,767

[22] Filed: Jun. 22, 1988

[51] Int. Cl.[4] ..... B65H 20/20

[52] U.S. Cl. ..... 226/74

[58] Field of Search ..... 226/74, 75, 170; 400/616, 616.1, 616.2; 474/101, 111, 136, 138, 148

[56] References Cited

U.S. PATENT DOCUMENTS

| | | | |
|---|---|---|---|
| 4,194,660 | 3/1980 | Seitz | 226/74 |
| 4,226,353 | 10/1980 | Blaskovic et al. | 226/74 |
| 4,351,637 | 9/1982 | Dixon | 474/148 |
| 4,502,233 | 5/1985 | Boitz et al. | 474/148 X |
| 4,640,687 | 2/1987 | MacCarthy, Sr. | 474/101 |

*Primary Examiner*—John M. Jillions

*Attorney, Agent, or Firm*—Dale C. Hogue, Sr.

[57] ABSTRACT

A paper handling system for a printer or copier has a forms feed tractor employing a sliding sprocket assembly and idler sprocket. The idler sprocket is mounted on the sliding sprocket assembly providing for adjusting the tension on the belt. The sliding sprocket assembly also has an inclined ramp thus providing a symmetric belt path.

26 Claims, 4 Drawing Sheets

Fig. 2
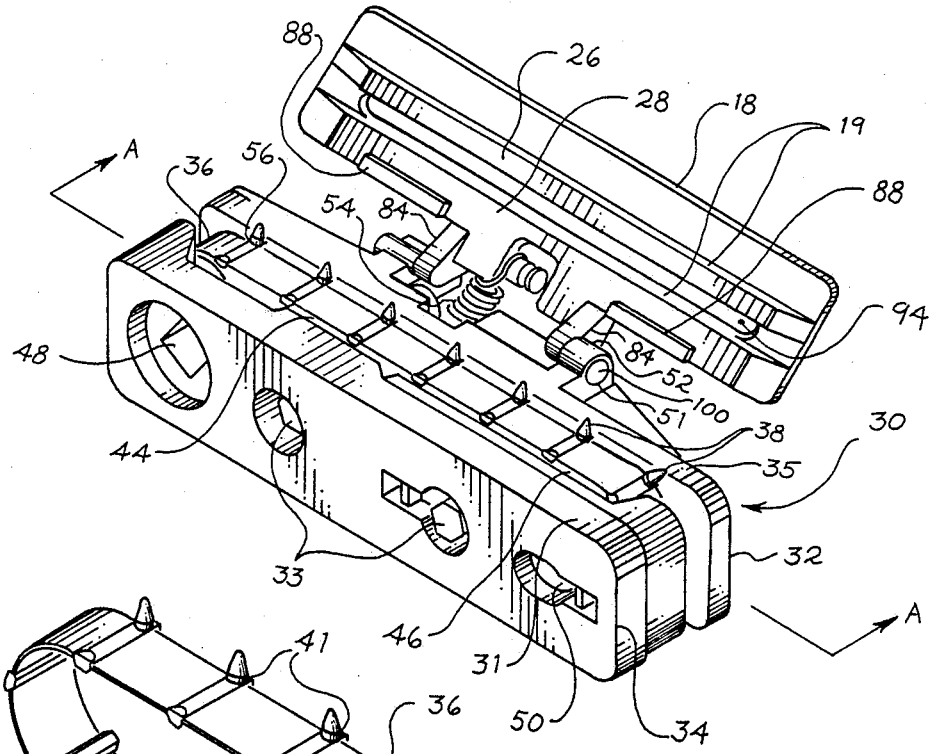
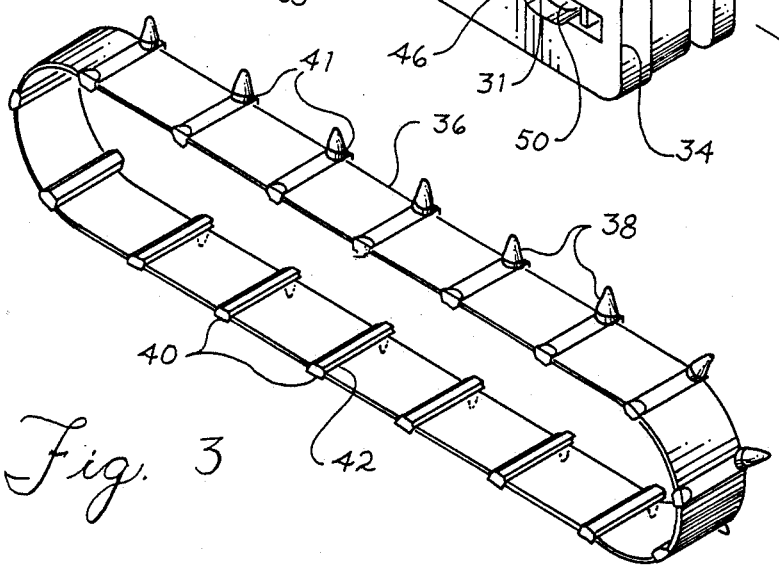
Fig. 3

FORMS FEED TRACTOR

BACKGROUND OF THE INVENTION

1. Technical Field

This invention relates to a forms feed tractor and, more particularly to a continuous forms feed tractor for moving a web or record medium such as paper having edge perforations, through a printer, copier or other similar apparatus operating upon the record medium.

2. Background Art

Forms feed tractor mechanisms have been used to move continuous forms or computer paper through printers for many years. The paper utilized has pre-punched holes, called perforations, along both sides. A pair of oppositely mounted tractor mechanisms are provided in the paper handling portion of the apparatus. The pins of the tractor are inserted into the pre-punched holes, engage the paper and move it forward through the apparatus. Generally, the tractor pins are arranged on a belt in an endless loop with at least one sprocket means provided for rotating the endless loop thereby causing the pins and paper to move.

In one configuration of a prior art tractor, the belt is driven by the drive sprocket around a non-rotating tensioner or shoe. As the belt moves in a complex belt path around the shoe its effective chordal length changes. Chordal length is the distance between pins of the belt. This change in length is the result of varying tension in the belt. As the pins of the belt move through a range of positions due to the maximum and minimum tensioning, the chordal length and belt tension vary sinusoidally. This creates some undesirable conditions. Since chordal length and tension vary, high belt tension must be introduced to achieve accurate forms registration. As tension increases, the frictional forces between the belt and shoe increase necessitating an increase in the amount of torque required to drive the tractor. A further undesirable result is that a more powerful and hence more expensive motor is needed to drive the apparatus; otherwise, the paper will be improperly positioned in the printer or copier resulting in poor image formation. Moreover, the change in chordal length and tension mean that the belt is undergoing cyclical stress fluctuations which has a fatiguing effect on the belt. In addition, the belt is being fixed around the base of the drive teeth as it moves around the tensioner due to geometrical changes of chord length which also results in fatiguing the belt. Examples of tractors employing a non-rotating tensioner or shoe can be found in U.S. Pat. Nos. 4,199,091; 4,226,353; 4,453,660; 4,614,287; 4,614,508 and 4,707,158.

In other prior art tractors, either fixed center or spring loaded idler sprockets are used. With the fixed center sprocket, obtaining consistent belt tension is very difficult unless tolerances are tightly held which adds significant extra expense. If tolerances are not tightly held, belt tension will vary greatly causing inaccurate paper registration and poor image formation. In the case of the spring loaded sprocket, the magnitude and consistency of the belt tension is determined largely by the spring. Examples of tractors employing idler sprockets are described in U.S. Pat. Nos. 3,688,959; 3,825,162; 3,938,721; 4,130,230; 4,159,794 and 4,194,660.

Numerous attempts to overcome these difficulties have been attempted but with unsatisfactory results.

SUMMARY OF THE INVENTION

It is an object of this invention to provide an improved forms feed tractor that combines the advantages of an idler sprocket without the disadvantages of poor tension and complex belt path. These and other advantages are achieved by providing a web drive means comprised of a frame having a sprocket mounting means and a belt supporting member. A drive sprocket is mounted on the sprocket mounting means and drivingly engages a drive shaft. A sliding sprocket assembly is also mounted on the frame. The sliding sprocket assembly has an idler sprocket, an adjustable biasing means for fixing the spaced relationship of the drive and idler sprockets and a ramp portion adjacent to both the belt supporting member and the idler sprocket. An endless flexible belt is in driven engagement with the drive sprocket and rotatably engages the idler sprocket, riding on the ramp portion and support member along a symmetric belt path. By employing a sliding sprocket assembly having a rotating idler sprocket and a ramp for guiding the belt along a symmetric belt path the deficiencies of the prior art are avoided.

Other advantages achieved by this invention are that chordal length and belt tension remain constant resulting in very accurate forms movement with good paper registration at lower belt tension. With less tension in the belt, less torque is required to drive the tractor eliminating the need for a more powerful and expensive motor. Also, this invention eliminates varying belt tension thus extending the life of the belt. Another advantage of the invention is the symmetric belt path which stops the belt from flexing around the base of the drive teeth thus avoiding belt fatigue and increasing belt life. Also, a symmetric belt path allows one tractor design to be used for both left hand and right hand feeding.

Advantages of this invention are also realized by providing a method of assembling a web drive means having a sliding sprocket assembly with an idler sprocket mounted thereon, a drive sprocket, a frame and a belt. The method comprises mounting and fixing the drive sprocket on the frame, then mounting the sliding sprocket assembly on the frame. Next, the belt is mounted on the drive and idler sprockets in the frame. The sliding sprocket assembly is adjusted to a position that provides a predetermined tension on the belt. Finally, the sliding sprocket assembly is locked into position.

Another advantage of this invention is provided in the method of assembly of the tractor. Because belt tension is adjusted in the assembly process, tolerances on the parts do not have to be held as closely as in fixed center arrangements; this results in parts that are easier to manufacture and less expensive. Another advantage is that belt tension does not vary greatly from tractor to tractor providing for much greater accuracy and paper registration in the printer or copier system incorporating the tractor.

An additional advantage of this invention is the elimination of springs. Because spring tolerances are not generally held very tightly, the belt tension varies as the spring tension varies. This invention avoids the need for either using expensive tight toleranced springs or accepting poor quality paper registration. More significant, however, is the positive effect removal of the spring has on paper registration. In the spring loaded arrangement, there is some amount of spring deflection causing a variation in belt tension that results in paper mis-registration. With this invention the idler sprocket is fixed in position putting a predetermined constant tension on the belt thus improving registration.

BRIEF DESCRIPTION OF THE DRAWINGS

FIG. 2 is a form feed tractor incorporating the features of the invention;

FIG. 3 is a belt useful in practicing the invention;

DETAILED DESCRIPTION OF THE PREFERRED EMBODIMENT

Figure 1:
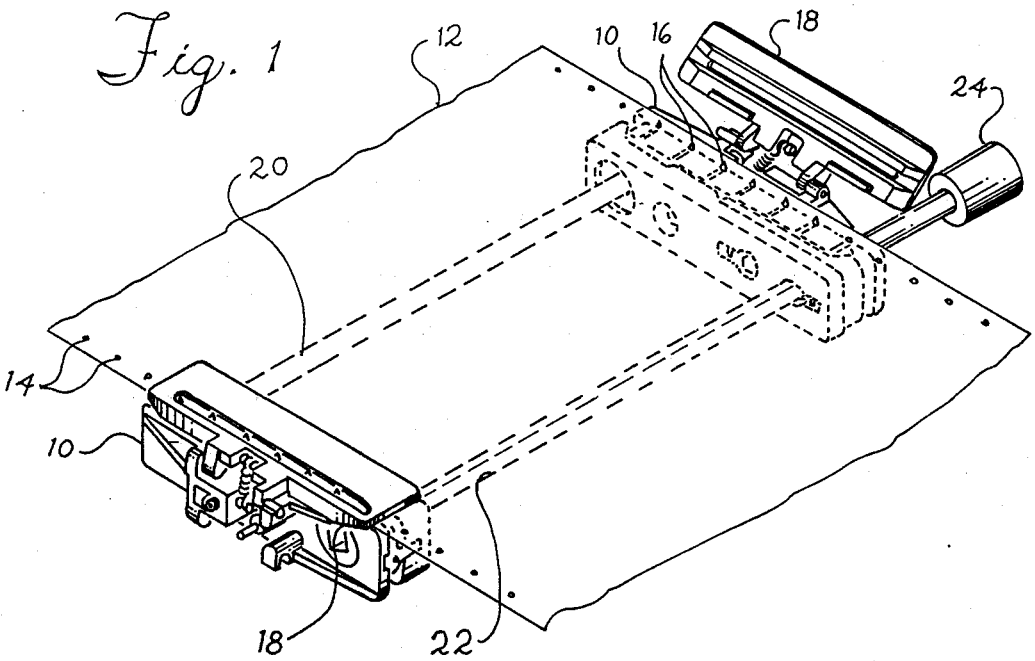
FIG. 1 shows a pair of forms feed tractors as part of a paper handling system.

Referring to FIG. 1, a pair of forms feed tractors 10 are shown as they would be mounted in a paper handling apparatus such as would be used in a printer or copier. Web 12 is shown as conventional computer paper having edge perforations 14, however, web 12 could also be multi-part continuous forms or other material for forming images on the surface thereof. The web 12 is loaded into the tractors by opening the hinged door 18, placing the web perforations over the drive pins 16, and closing the door. Web 12 is driven by pins 16 of forms feed tractor 10 which engage the web at edge perforations 14. The web is pressed onto the pins 16 by door 18 also known as a lid. Tractor 10 is held in position by means of guide shaft 20 and drive shaft 22. The pins 16 of tractor 10 are rotated in either a forward or reverse direction by drive shaft 22 which is driven by a suitable drive means 24 such as either a stepper motor or DC servo motor. A paper handling apparatus that could incorporate the forms feed tractors of this invention is described in U.S. Pat. No. 4,671,686 commonly owned by the assignee of this invention.

Referring now to FIGS. 2 and 3, a forms feed tractor has a frame 30 comprised of an outer side frame 32 and an inner side frame 34. The two side frames are held together by locking members 33. Belt 36 is mounted in frame 30 and has pins 38, drive teeth 40 which are connected to belt 36 at drive tooth base 42. Chordal length 41 is the distance between adjacent pins 38 of belt 36 and should be a constant. Belt 36 rides in frame 30 along a belt path defined by shoulder 44 and ramp 46. Drive aperture 48 and guide shaft aperture 50 are for receiving drive shaft 22 and guide shaft 20 respectively (FIG. 1). Door 18 is mounted on outer side frame 32 at hinge 52 with spring 54 provided to maintain pressure on the record medium so that the forms are positioned near the base 56 of pins 38.

The endless belt 36 is typically a strip of non-stretchable polyimide film, such as Kapton. It includes a plurality of attached, uniformly spaced drive pins 38 that extend outwardly from the belt surface. Drive teeth 40 may be integrally formed with the drive pin, and extent inwardly of the belt. Each tooth has a cross-sectional configuration that is complementary to the configuration of the axial slots on the sprockets.

Still referring to FIG. 2, the tractor door 18 is generally of the same size as the tractor guiding surfaces 31, 35 and is hinged on the outer side frame 32, outboard of the edge of the web. The body of the door is generally flat, or as depicted in the figures, includes a pair of ribs 19 extending downwardly therefrom, generally aligned and coextensive with the track of the pins or the tractor guiding surfaces 31, 35. In this embodiment one rib is disposed on each side of the pins and together they define a slot 94 along which the pins move. The lower guiding surfaces 26, 28 of the ribs are smooth to avoid snagging the web.

The door is hinged to the tractor by a pair of outwardly extending door arms 84 with protruding hinge pins 100 that are pivotally received in cradle 51 and hinge 52 adjacent the outer guiding surface 31 for the outer side frame 32. An extension spring 54 has opposite ends stretched between the door 18 and side frame 32 to either hold the door in its open loading position (FIG. 2) or in its closed driving position (FIG. 1).

The door, when closed, is spaced from the tractor guiding surfaces 31, 35 by a pair of door stops 88. Each door stop is disposed outboard of the edge of the web and extends downwardly from the under surface of the door to abut against the tractor guiding surface 35. Alternatively, the stop can be integrally molded into surface 31, 35. The height of the door stop determines the spacing between the tractor guiding surface and the lower surface of the door ribs. The door stop may be formed as an integral part of the outboard rib, as shown, or be a separate element.

Figures 4, 5:
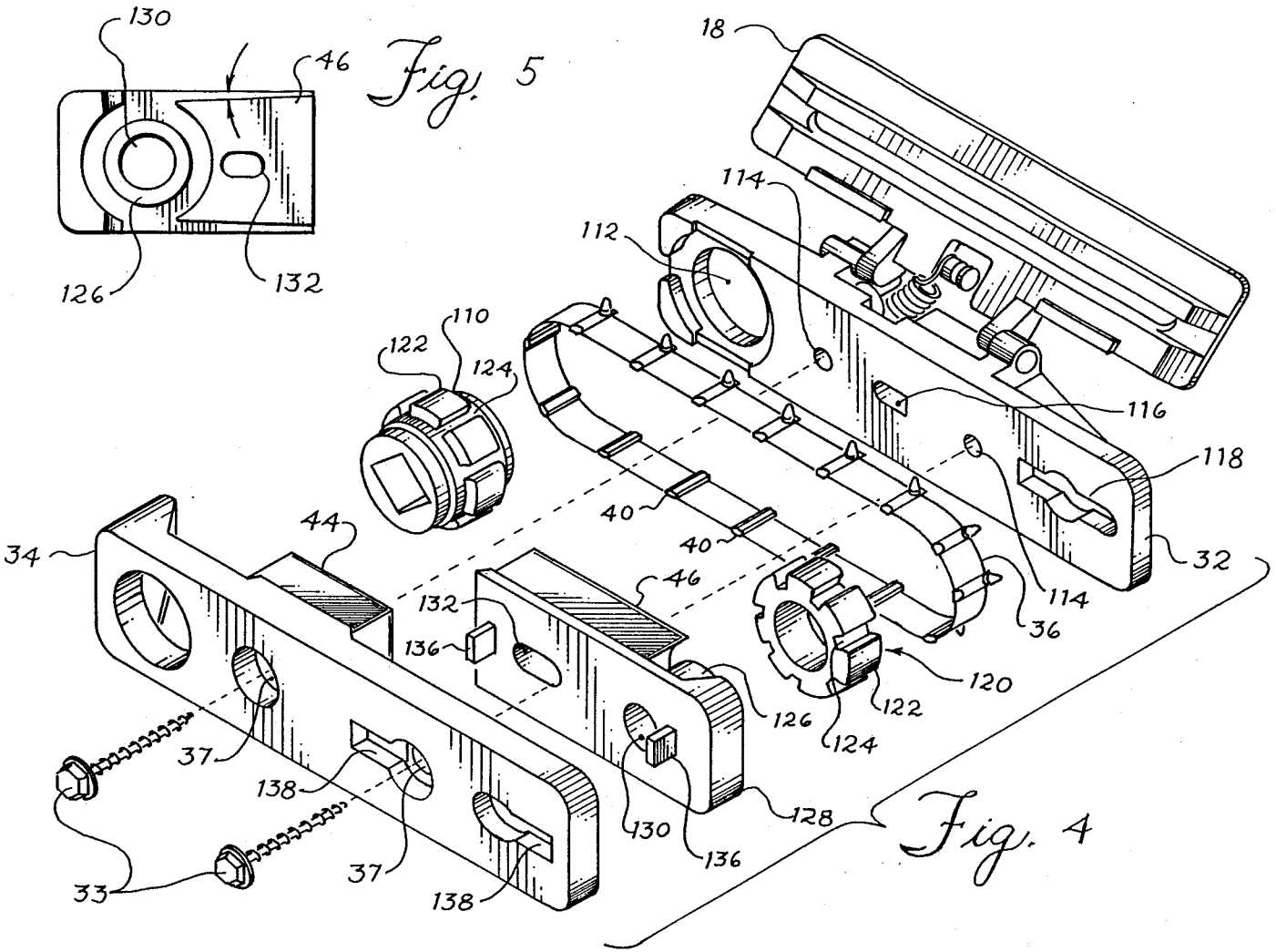
FIG. 4 is an exploded view of the form feed tractor of FIG. 2.
FIG. 5 is a plan view of the sliding sprocket assembly of the invention.

Referring to FIG. 4, outer side frame 32 is journalled to receive drive sprocket 110 at sprocket mounting hole 112. Also provided in outer side frame 32 are a pair of locking holes 114 and a locating hole 116. Guide shaft bearing member 118 is journaled to receive guide shaft 20 (FIG. 1).

Drive sprocket 110 and idler sprocket 120 have cogs 122 and slots 124. Drive teeth 40 of belt 36 fit in slots 124 and as drive sprocket 110 is driven by drive shaft 22 and suitable motor means the belt is caused to turn.

Idler sprocket 120 fits on sprocket mount 126 of sliding sprocket assembly 128 about locking member 33. Sprocket mount 126 also has shaft support hole 130 for receiving guide shaft 20 (FIG. 1). Positioning hole 132 is provided with an eliptical dimension allowing for movement of the entire sliding sprocket assembly 128. Pump 46 is positioned adjacent to idler sprocket 120 so that drive teeth 40 are supported as they pass between idler sprocket 120 and ramp 46. Locating pins 136 mate with complementary allies 138 of inner side frame 34.

Ramp 46 is provided with a slight slope, more clearly shown in FIG. 5, so that the combination of ramp 46, shoulder 44 of inner side frame 34, drive sprocket 110 and idler sprocket 120 provides a symmetric belt path for belt 36. In the preferred embodiment, ramp 46 has a slope or inclination of approximately 2 degrees.

Still referring to FIG. 4, the method of assembling a forms feed tractor of the invention shall be described. Drive sprocket 110 and sliding sprocket assembly 128 are mounted on inner side frame 34. Next, idler sprocket 120 is mounted on sprocket mount 126 of sliding sprocket assembly 128. Belt 36 is fitted over drive sprocket 110 and idler sprocket 120 such that the drive teeth 40 are fitted in the slots 124 with the underside of belt 36 supported by cogs 122. Outer side frame 32 is then mated to the assembled second side frame 34, sliding sprocket assembly 128, drive sprocket 110, idler sprocket 120 and belt 36. Locking members 33 are inserted in their respective positioning holes 37 and then tightened to hold the entire assembly in place but not so tight as to inhibit the sliding movement of sliding sprocket assembly 128 which is then adjusted to place a predetermined tension on belt 36 using a fixture and force gauge as is well known to those skilled in the art. When the predetermined tension is obtained, locking members 33 are tightened to prevent any additional sliding movement of sliding sprocket assembly 112.

Figure 7:
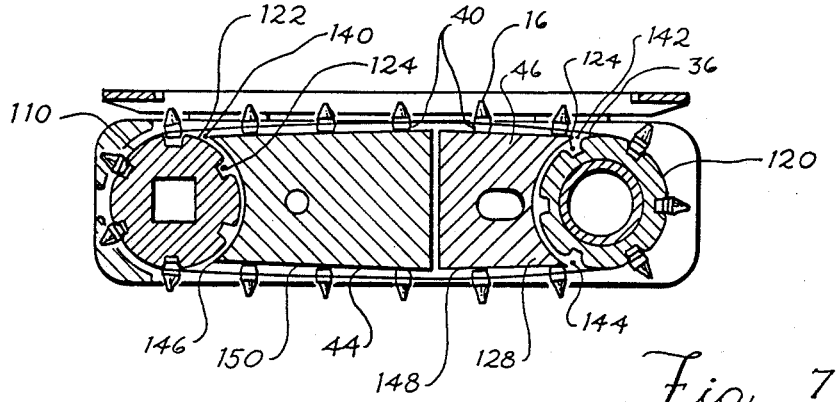
FIG. 7 is a view taken along the line A-A of FIG. 2.

The symmetric belt path achieved by this invention is shown in FIG. 7. Drive teeth 40, of belt 36, which are shown to have a trapezoidal cross section, fit within complementary slots 124 of drive sprocket 110 and idler sprocket 120. While the present embodiment shows drive teeth having a trapezoidal cross section it should be understood that any cross sectional shape, such as, but not limited to hemi-spherical, hemi-cylindrical or rectangular would work as well.

The drive teeth 40 travel on the symmetric belt path as follows: Teeth 40 seated in slots 124 of drive sprocket 110 are driven along in a clockwise direction to drive gap 140. The teeth 40 traverse gap 140 and ride along the top of shoulder 44. As drive sprocket 110 continues to turn, cog 122 and slot 124 fall away from tooth 40. Gap 140 and similarly idler gap 142 are critical zones where the pins 16 enter and exit the paper holes. As the tooth traverses gap 140 there is a tendency for it to fall, however, the tension on the belt 36 and the narrowness of the gaps 140, 142 combine to alleviate this problem. After passing gap 140, the tooth continues on the path supported by shoulder 44 passing onto ramp 46 after which it must traverse idler gap 142 to enter slot 124 to idler sprocket 120. As the pin 16 and tooth 40 follow along a return path between idler sprocket 120 and drive sprocket 110 they encounter lower idler gap 144 and lower drive gap 146. In the present embodiment paper is not fed along the return path, but as this tractor can be used in either right hand or left hand configurations gaps 144, 146 are critical paper exit/entry zones. The belt tension achieved with the sliding sprocket assembly 128 and the spreading effect provided by bottom ramp 148 and bottom shoulder 150 maintain the belt in a symmetric path.

Figure 6:
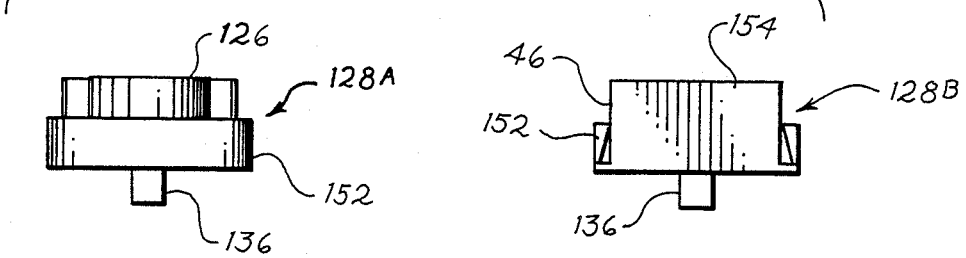
FIG. 6 shows the two end views of the sliding sprocket assembly.

FIG. 6 shows the two end views of sliding sprocket assembly 128 without idler sprocket 120 mounted thereon. Referring to sliding sprocket 128A, wall 152 is lower than sprocket mount 126. Stop 154 of ramp 46 is shown on sliding sprocket 128B.

Figure 8A:
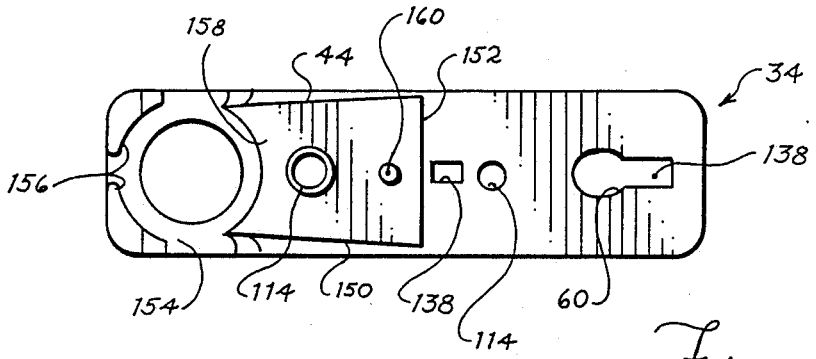
FIGS. 8A and 8B are the side and end views of the inner and outer side frames.

Referring to FIG. 8A, the inside view of inner side frame 34 without sliding sprocket assembly 128 shows shoulder 44 and bottom shoulder 150. Sprocket well 154 is provided for positioning drive sprocket 110. End wall 156 is lower than inner wall 158 to permit the pins 16 of belt 36 to travel around drive sprocket 110 unimpeded by an obstructing wall. Alley 138 allows free movement of locating pins 136 (FIG. 4) in the direction away from wall 152. Guide shaft 20 (FIG. 1) is located in guide shaft aperture 50 which also acts as a stop. Locking holes 114 have a diameter narrower than locking members 33 (FIG. 4). In the preferred embodiment, locking members 33 are self-tapping screws. Pin 160 mates with locating hole 116 (FIG. 4) of outer side frame 32 to provide precise assembly.

In the preferred embodiment, outer side frame 32, door 18, drive sprocket 110, idler sprocket 122, sliding sprocket assembly 128 and inner side frame 34 are all constructed of polycarbonate though other materials may be substituted as a matter of design choice.

Figure 8B:
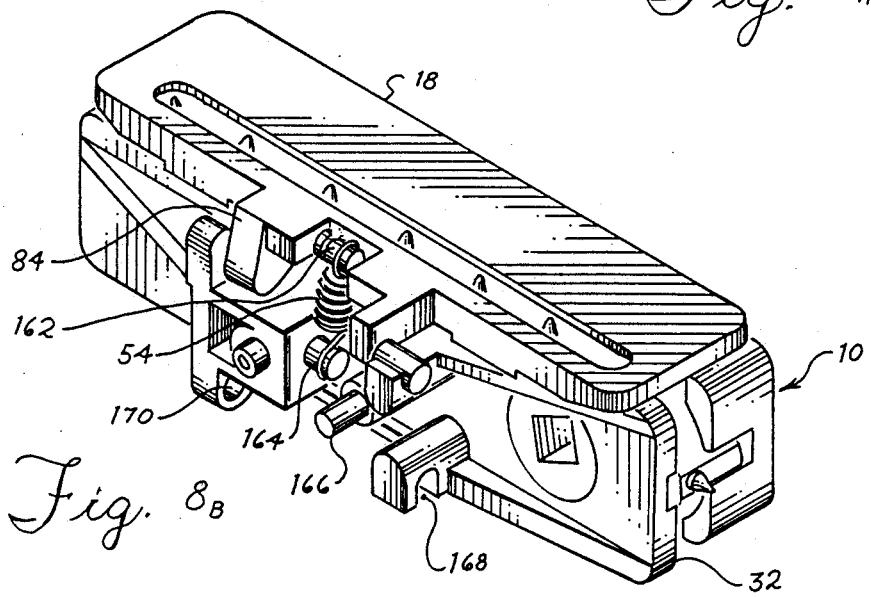

Referring to FIG. 8B, an outside view of forms feed tractor 10 showing the rear details of outer side frame 32 is illustrated with door 18 in a closed position. Door 18 has door arm 84 with door post 162 connected to lower post 164 by spring 54. Pin 166 is provided to position the tractor accurately in the paper handling apparatus (FIG. 1).

The symmetric belt path of the present invention permits the use of one tractor design for both sides of the paper handling apparatus. As shown in FIG. 8B, hinge 170 is opposite hinge 52 and cradle 168 is opposite cradle 51. The tractor of FIG. 8B is disposed for left hand feeding. To change the feeding direction to right hand feeding door 18 would be mounted on the opposite side of the tractor using hinge 170 and cradle 168.

The general construction of the tractor and belt has been disclosed in sufficient detail to describe the present invention, and the reader is referred to U.S. Patent Nos. 4,226,353 to Blaskovic et al entitled Forms Feed Tractor and 4,453,660 to Cornell et al entitled Forms Feed Tractor for additional information. These patents are commonly owned by the assignee of the present invention.

From the above description, it will be understood by those having skill in the art that according to the present invention a forms feed tractor having an idler sprocket mounted on a ramped frame provides proper tensioning of the belt and a symmetric pin entry and exit path.

While the invention has been particularly shown and described with reference to a preferred embodiment, it will be understood by those skilled in the art that various other changes in form and detail may be made without departing from the spirit and scope of the invention.

We claim:

1. A web drive means for advancing a media along a path, comprising:

a unitary sprocket assembly having an alignment surface, and an idler sprocket rotatably mounted on said unitary sprocket assembly, said alignment surface having a declining slope away from the path of said media and said alignment surface and said idler sprocket being in fixed alignment to each other;

a drive sprocket;

a frame for receiving said unitary sprocket assembly and said drive sprocket and having a belt support shoulder between said unitary sprocket assembly and said drive sprocket in alignment with said alignment surface providing a symmetric belt path;

an endless belt in driven engagement with said drive sprocket and rotatably engaging said idler sprocket along said symmetric belt path;

said alignment surface having an upper ramp and a lower ramp, said endless belt support shoulder having an upper shoulder and a lower shoulder, said upper ramp being in alignment with said upper shoulder and said lower ramp being in alignment with said lower shoulder; and means to secure said unitary sprocket assembly into a fixed position relative to said frame and to apply tension to said endless belt.

2. A tractor mechanism for moving a record medium having edge perforations, said tractor mechanism comprising:

inner and outer side frames;

a drive sprocket mounted between said side frames;

an idler sprocket assembly, adjustably mounted between said side frames, having a ramp, a sprocket mount arranged in a fixed space relationship to said ramp, for receiving an idler sprocket and a shaft, and an idler sprocket mounted on said sprocket mount;

a belt support shoulder between said side frames in alignment with said ramp; and an endless belt having pin means for engaging said edge perforations, drive teeth means for engaging said drive and idler sprockets, and supported by said ramp and said belt support shoulder, said ramp being adapted for guiding the drive teeth means downwardly, thereby withdrawing the pin means from the edge perforations.

3. A tractor mechanism as in claim 2 wherein the fixed space relationship between said ramp and said sprocket mount is maintained when the position of the idler sprocket is adjusted relative to the drive sprocket.

4. The web drive means of claim 2 further comprising a belt path symmetric about a line between said drive sprocket and said idler sprocket.

5. The tractor mechanism of claim 2 wherein said ramp has an upper ramp and a lower ramp, said belt support shoulder has an upper shoulder and a lower shoulder and said upper shoulder is in alignment with said upper ramp and said lower shoulder is in alignment with said lower ramp.

6. The web drive means of claim 2 wherein said frame has at least two door mounting means.

7. The web drive means of claim 6 wherein said drive shaft is driven by electric motor means.

8. The tractor mechanism of claim 2 wherein said outer frame further comprises means for mounting doors in at least two positions.

9. The web drive means of claim 2 wherein said ramp has an inclination of no more than 2 degrees.

10. The web drive means of claim 2 wherein said drive shaft is driven by electric motor means.

11. The tractor mechanism of claim 2 wherein said ramp and said idler sprocket form a critical zone having a gap equal to or less than the width of said drive teeth means.

12. The tractor mechanism of claim 2 wherein said ramp and said idler sprocket form a critical zone having a gap substantially less than the width of said drive teeth means.

13. A method of assembling a tractor mechanism wherein said tractor mechanism has an outer side frame and an inner side frame, said assembly method comprising:

fixably mounting a drive sprocket on one of said side frames;

adjustably mounting a sliding sprocket assembly with an idler sprocket and a ramp one of said side frames;

mounting said endless belt around said drive sprocket and said idler sprocket;

mating said outer and inner side frames;

adjusting said sliding sprocket assembly to a position for providing a predetermined tension in said belt; and fastening said sliding sprocket assembly in said position.

14. A method of assembling a tractor mechanism wherein said tractor mechanism has an outer side frame for receiving a drive sprocket, a sliding sprocket assembly with an idler sprocket and a ramp, an inner side frame for receiving said sliding sprocket assembly and having a belt support shoulder, and a belt with pin means for engaging edge perforations of a web and drive teeth means for engaging said drive and idler sprockets, said assembly method comprising:

fixably mounting said drive sprocket on said outer side frame;

adjustably mounting said sliding sprocket assembly on said inner side frame;

mating said outer and inner side frames and mounting said belt on said drive and idler sprockets;

adjusting said sliding sprocket assembly to a position for providing a predetermined tension in said belt; and fastening said sliding sprocket assembly in said position.

15. A method of assembling a web drive means having a sliding sprocket assembly with an idler sprocket mounted thereon, a drive sprocket, a frame and an endless belt, the method comprising:

mounting and fixing said drive sprocket on said frame;

mounting said sliding sprocket assembly on said frame;

mounting said endless belt on said drive sprocket and said idler sprocket;

adjusting said sliding sprocket assembly to a position for providing a predetermined tension in said belt; and locking said sliding sprocket assembly in said position.

16. A method of assembling a web drive means having a sliding sprocket assembly with an idler sprocket mounted thereon, a drive sprocket, a frame and a belt, the method comprising:

mounting and fixing said drive sprocket on said frame;

mounting said sliding sprocket assembly on said frame;

mounting said belt on said drive sprocket and said idler sprocket in said frame;

adjusting said sliding sprocket assembly to a position for providing a predetermined tension in said belt; and locking said sliding sprocket assembly in said position.

17. A web drive means comprising:

a frame having a sprocket mounting means, an upper belt supporting member and a lower belt supporting member;

a drive sprocket mounted on said sprocket mounting means and drivingly engaging a drive shaft;

an idler assembly mounted on said frame, said assembly having an idler sprocket, an upper ramp portion and a lower ramp portion, said upper ramp portion adjacent said upper belt supporting member and said idler sprocket and said lower ramp portion adjacent said lower belt supporting member and said idler sprocket; and an endless flexible belt in driven engagement with said drive sprocket and rotatably engaging said idler sprocket and riding on said upper and lower ramp portions and said upper and lower supporting members.

18. The web drive means of claim 17 wherein said frame has at least two door mounting means.

19. The web drive means of claim 17 wherein said drive shaft is driven by electric motor means.

20. A web drive means comprising:

a sliding sprocket assembly having an upper ramp, a lower ramp, an idler sprocket and at least one locating means;

a drive sprocket;

a frame for receiving said sliding sprocket assembly and said drive sprocket and having upper and lower belt support shoulders in alignment with said upper and lower ramps providing a symmetric belt path; and an endless belt in driven engagement with said drive sprocket and rotatably engaging said idler sprocket along said symmetric belt path.

21. A tractor mechanism for moving a record medium having edge perforations, said tractor mechanism comprising:

an outer side frame for receiving a drive sprocket;

a sliding sprocket assembly, adjustably mounted on an inner side frame, having upper and lower ramps, a sprocket mount for receiving an idler sprocket and a shaft, and an idler sprocket mounted on said sprocket mount;

upper and lower belt support shoulders in alignment with said upper and lower ramps and affixed to said second side frame; and an endless belt having pin means for engaging said edge perforations, drive teeth means for engaging said drive and idler sprockets, and supported by said upper and lower ramps and said upper and lower belt support shoulders.

22. The tractor mechanism of claim 21 wherein said outer frame has an upper door mounting means and a lower door mounting means.

23. The tractor mechanism of claim 21 wherein said ramp and said idler sprocket form a critical zone having a gap equal to or less than the width of said drive teeth means.

24. The tractor mechanism of claim 21 wherein said ramp and said idler sprocket form a critical zone having a gap substantially less than the width of said drive teeth means.

25. A method of assembling a tractor mechanism wherein said tractor mechanism has an outer side frame for receiving a drive sprocket, a sliding sprocket assembly with an idler sprocket and a ramp having upper and lower portions, an inner side frame for receiving said sliding sprocket assembly and having a belt support shoulder with upper and lower portions, and an endless belt with pin means for engaging edge perforations of a web and drive teeth means for engaging said drive and idler sprockets, said assembly method comprising:

mounting fixably said drive sprocket on said outer side frame;

mounting adjustably said sliding sprocket assembly on said inner side frame;

mounting said endless belt on said drive sprocket;

mating said outer and inner side frames and mounting said endless belt on said idler sprocket, said ramp and said support shoulder;

adjusting said sliding sprocket assembly to a position for providing a predetermined tension in said belt; and fastening said sliding sprocket assembly in said position.

26. A method of assembling a tractor mechanism wherein said tractor mechanism has an outer side frame for receiving a drive sprocket, a sliding sprocket assembly with an idler sprocket and a ramp having upper and lower portions, an inner side frame for receiving said sliding sprocket assembly and having a belt support shoulder with upper and lower portions, and a belt with pin means for engaging edge perforations of a web and drive teeth means for engaging said drive and idler sprockets, said assembly method comprising:

mounting fixably said drive sprocket on said outer side frame;

mounting adjustably said sliding sprocket assembly on said inner side frame;

mating said outer and inner side frames and mounting said belt on said drive and idler sprockets and on said ramp and said belt support shoulder;

adjusting said sliding sprocket assembly to a position for providing a predetermined tension in said belt; and fastening said sliding sprocket assembly in said position.

* * * * *